US011017792B2

(12) United States Patent
Hera et al.

(10) Patent No.: US 11,017,792 B2
(45) Date of Patent: May 25, 2021

(54) MODULAR ECHO CANCELLATION UNIT

(71) Applicant: Bose Corporation, Framingham, MA (US)

(72) Inventors: Cristian M. Hera, Lancaster, MA (US); Elie Bou Daher, Marlborough, MA (US); Jeffery R. Vautin, Worcester, MA (US); Vigneish Kathavarayan, Marlborough, MA (US); Ankita D. Jain, Westborough, MA (US); Tobe Z. Barksdale, Bolton, MA (US)

(73) Assignee: Bose Corporation, Framingham, MA (US)

( * ) Notice: Subject to any disclaimer, the term of this patent is extended or adjusted under 35 U.S.C. 154(b) by 73 days.

(21) Appl. No.: 16/443,292

(22) Filed: Jun. 17, 2019

(65) Prior Publication Data

US 2020/0395030 A1 Dec. 17, 2020

(51) Int. Cl.

*G10L 21/0216* (2013.01)
*G10L 21/0308* (2013.01)
*G10L 21/0208* (2013.01)

(52) U.S. Cl.

CPC ..... *G10L 21/0216* (2013.01); *G10L 21/0308* (2013.01); *G10L 2021/02082* (2013.01); *G10L 2021/02166* (2013.01)

(58) Field of Classification Search

None

See application file for complete search history.

(56) References Cited

U.S. PATENT DOCUMENTS 7,117,145 B1 * 10/2006 Venkatesh ..... G10L 21/0208 704/200
7,672,445 B1 * 3/2010 Zhang ..... H04M 9/082 379/406.01

(Continued)

FOREIGN PATENT DOCUMENTS

WO 2019028115 2/2019

OTHER PUBLICATIONS

International Search Report and the Written Opinion of the International Searching Authority, International Application No. PCT/US2020/038105, pp. 1-9, dated Oct. 1, 2020.

*Primary Examiner* — Douglas Godbold

(74) *Attorney, Agent, or Firm* — Bond, Schoeneck & King, PLLC

(57) ABSTRACT

An audio system includes: a head unit comprising at least a first processor, the head unit being configured to generate a plurality of program content signals, one of the plurality of program content signals being a phone program content signal being received from a phone, wherein the plurality of program content signals are transduced by an acoustic transducer into an acoustic signal within a vehicle cabin; a microphone disposed within the vehicle cabin such that the microphone receives the acoustic signal and produces a microphone signal comprising a plurality of echo signals; and a multichannel echo-cancellation unit being implemented by a second processor, the multichannel echo-cancellation unit being configured to receive a plurality of reference signals and to minimize the plurality of echo signals, according to the plurality of reference signals, to produce an estimated voice signal, and to provide the estimated voice signal to the head unit.

20 Claims, 5 Drawing Sheets

(56) References Cited

U.S. PATENT DOCUMENTS

| | | | | |
|---|---|---|---|---|
| 9,275,625 | B2 * | 3/2016 | Kim | G10K 11/16 |
| 9,373,320 | B1 * | 6/2016 | Lyon | G10L 21/0308 |
| 2002/0172350 | A1 * | 11/2002 | Edwards | G10L 21/02 379/392.01 |
| 2005/0159945 | A1 * | 7/2005 | Otsuka | G10L 15/20 704/226 |
| 2007/0136053 | A1 * | 6/2007 | Ebenezer | G10H 1/0058 704/208 |
| 2008/0304675 | A1 * | 12/2008 | Roovers | H04M 9/082 381/66 |
| 2016/0029124 | A1 * | 1/2016 | Paranjpe | H04R 3/02 381/71.14 |
| 2020/0194019 | A1 * | 6/2020 | Kostic | H04M 9/082 |

* cited by examiner

MODULAR ECHO CANCELLATION UNIT

BACKGROUND

The present disclosure generally relates to systems and methods for a modular echo cancellation, and specifically to systems and methods for providing modular echo cancellation in a vehicle.

SUMMARY

All examples and features mentioned below can be combined in any technically possible way.

According to an aspect, an audio system includes: a head unit comprising at least a first processor, the head unit being configured to generate a plurality of program content signals, one of the plurality of program content signals being a phone program content signal being received from a phone, wherein the plurality of program content signals are transduced by an acoustic transducer into an acoustic signal within a vehicle cabin; a microphone disposed within the vehicle cabin such that the microphone receives the acoustic signal and produces a microphone signal comprising a plurality of echo signals, each echo signal of the plurality of echo signals being a component of the microphone signal correlated to at least one program content signal of the plurality of program content signals; a multichannel echo-cancellation unit being implemented by a second processor, the multichannel echo-cancellation unit being configured to receive a plurality of reference signals, each of the plurality of reference signals being correlated to at least one of the plurality of program content signals, and the microphone signal, and to minimize the plurality of echo signals, according to the plurality of reference signals, to produce an estimated voice signal, and to provide the estimated voice signal to the head unit.

In an example, the multichannel echo-cancellation unit comprises a multichannel echo-cancellation filter configured to provide an estimate of the plurality of echo signals, the estimate of the plurality of echo signals being subtracted from the microphone signal to produce the estimated voice signal, wherein an estimated phone program content echo signal, being correlated to the phone program content signal, is added to the estimated voice signal, such that the estimated voice signal and the estimated phone program content echo signal is provided to the head unit.

In an example, the audio system further includes a post filter configured to receive the estimated voice signal and to suppress at least one residual component correlated to at least one of the plurality of program content signals to produce an echo-suppressed estimated voice signal.

In an example, the estimated phone program content echo signal is added to the echo-suppressed estimated voice signal.

In an example, the post filter is configured to receive the estimated voice signal and the estimated phone program content echo signal and to output the echo-suppressed estimated voice signal and the estimated phone program content echo signal, wherein the estimated phone program content echo signal remains unsuppressed.

In an example, the post filter is configured to output the estimated phone program content echo signal unsuppressed by excluding the estimated phone program content echo signal from a spectral mismatch summation.

In an example, the plurality of reference signals comprises the plurality of program content signals.

According to another aspect, a multichannel echo cancellation unit being implemented on a first processor, includes: at least one program content input to receive a plurality of reference signals, each of the plurality of reference signals being correlated to at least one of a plurality of program content signals output from a head unit including a second processor, one of the plurality of program content signals being a phone program content signal; a microphone input to receive a microphone signal comprising a plurality of echo signals, each echo signal of the plurality of echo signals being a component of the microphone signal correlated to at least one program content signal of the plurality of program content signals; an echo canceler being configured to minimize the plurality of echo signals, according to the plurality of reference signals, to produce an estimated voice signal and to provide the estimated voice signal to the head unit.

In an example, the echo canceler comprises a multichannel echo-cancellation filter configured to provide an estimate of the plurality of echo signals, the estimate of the plurality of echo signals being subtracted from the microphone signal to produce the estimated voice signal, wherein an estimated phone program content echo signal, being correlated to the phone program content signal, is added to the estimated voice signal, such that the estimated voice signal and the estimated phone program content echo signal is provided to the head unit.

In an example, the multichannel echo cancellation unit further includes a post filter configured to receive the estimated voice signal and to suppress at least one residual component correlated to the plurality of program content signals to produce an echo-suppressed estimated voice signal.

In an example, the estimated phone program content echo signal is added to the echo-suppressed estimated voice signal.

In an example, the post filter is configured to receive the estimated voice signal and the estimated phone program content echo signal and to output the echo-suppressed estimated voice signal and the estimated phone program content echo signal, wherein the estimated phone program content echo signal remains unsuppressed.

In an example, the post filter is configured to output the estimated phone program content echo signal unsuppressed by excluding the estimated phone program content echo signal from a spectral mismatch summation.

According to another aspect, the method for performing multichannel echo cancellation, includes: receiving, at a first processor, a plurality of reference signals, each of the plurality reference signals being correlated to at least one of a plurality of program content signals output from a head unit including a second processor, one of the plurality of program content signals being a phone program content signal; receiving a microphone signal comprising a plurality of echo signals, each echo signal of the plurality of echo signals being a component of the microphone signal correlated to at least one program content signal of the plurality of program content signals; minimizing, with an echo canceler defined by first processor, the plurality of echo signals, according to a plurality of reference signals, to produce an estimated voice signal; and providing the estimated voice signal to the head unit.

In an example, wherein the step of minimizing the plurality of echo signals comprises: generating, with a multichannel echo-cancellation filter being defined by the first processor, an estimate of the plurality of echo signals, the estimate of the plurality of echo signals being subtracted from the microphone signal to produce the estimated voice signal In an example, the method further includes: adding an estimated phone program content echo signal, being correlated to the phone program content signal, to the estimated voice signal, such that the estimated voice signal and the estimated phone program content echo signal is provided to the head unit.

In an example, the method further includes: receiving the estimated voice signal at a post filter, the post filter being implemented by the first processor; and applying a suppression, with the post filter, to at least one residual component correlated to the plurality of program content signals to produce an echo-suppressed estimated voice signal.

In an example, wherein the estimated phone program content echo signal is added to the echo-suppressed estimated voice signal.

In an example, the method further includes: receiving the estimated phone program content echo signal at the post filter; outputting, from the post filter, the estimated phone program content echo signal unsuppressed.

In an example, wherein the post filter is configured to output the estimated phone program content echo signal unsuppressed by excluding the estimated phone program content echo signal from a spectral mismatch summation.

The details of one or more implementations are set forth in the accompanying drawings and the description below. Other features, objects, and advantages will be apparent from the description and the drawings, and from the claims.

DETAILED DESCRIPTION

Vehicle head units typically include multiple subsystems for supplying program content signals such as music, navigation, and handsfree phone signal to an amplifier unit, which (often together with some associated processing) amplifies the program content signals for transduction into an audio signal by a speaker within the vehicle cabin. During a call utilizing the handsfree phone subsystem, a microphone, positioned within the vehicle cabin, will receive the user's voice signal, to be sent to a handsfree phone subsystem, where it is routed to the mobile device. If the speakers, however, are playing the program content signals in the vehicle cabin during the call, the microphone signal will include components correlated to the program content signals, as a result of receiving the acoustic program signals in the cabin. This is generally known as an echo signal and degrades the quality of the voice signal at the microphone.

In order to cancel the echo signal, an echo cancellation system may be included at the handsfree phone subsystem. But in order to cancel the echo of signals besides the phone signal echo, reference signals from the amplifier unit must be sent to the handsfree phone subsystem. Given the typically high number of channels at the amplifier unit, this may require an additional expensive bus for sending the program content reference signals from the amplifier unit to the handsfree phone subsystem. In addition, the time delay associated with sending signals over such a bus could introduce a significant delay that degrades the performance of the echo cancellation. Accordingly, there exists a need in the art for a modular echo cancellation unit that can introduce echo cancellation to the microphone signal at the amplifier unit, or at some other location convenient for receiving the reference signals.

Figure 1:
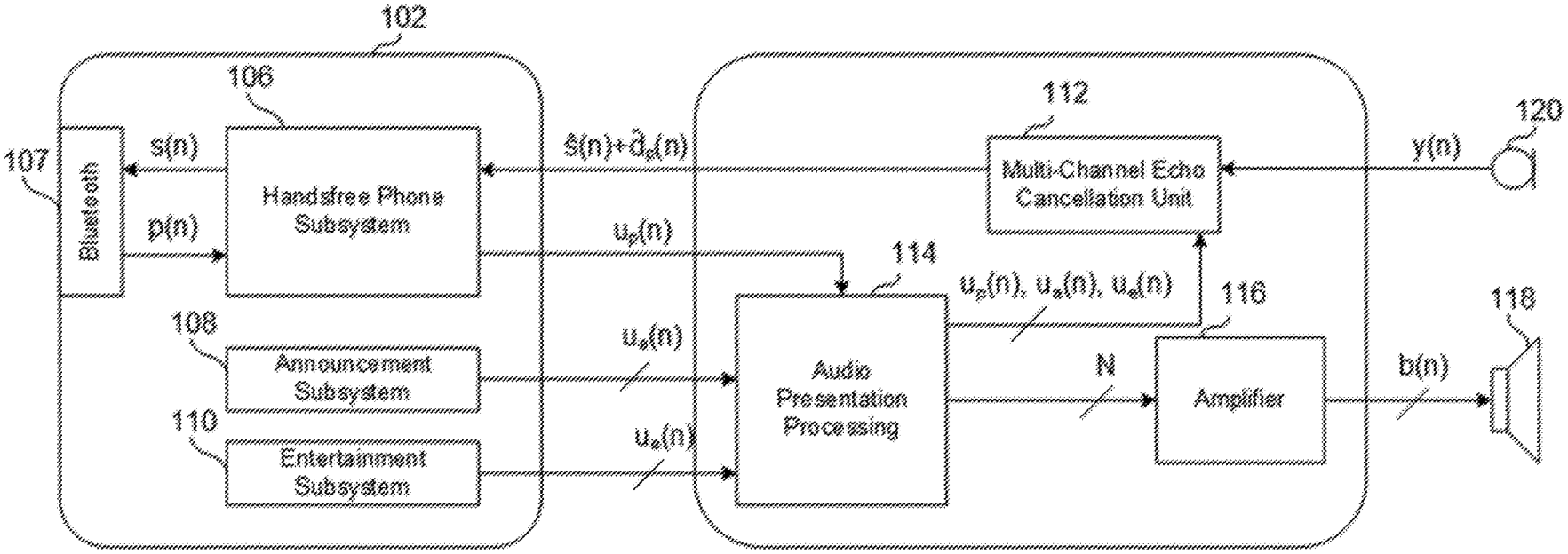
FIG. 1 is a schematic of a head unit and an amplifier unit, according to an example.

Various examples disclosed herein are directed to a modular echo-cancellation subsystem that may cancel the echo signals related to the program content signals received from the head unit. There is shown in FIG. 1 a block diagram of an audio system 100 implemented in a vehicle. As shown, the audio system 100 may include a head unit 102 and an amplifier unit 104. The head unit 102 may comprise a set of subsystems for generating program content to be processed and amplified by the amplifier unit 104. Some subsystems may include, for example, a handsfree phone subsystem 106, an announcement subsystem 108, and an entertainment subsystem 110. The handsfree phone subsystem 106 may provide a phone signal $u_p(n)$, received, for example, from a Bluetooth-connected cellular phone. The handsfree phone subsystem 106 may also receive from the amplifier unit 104 a microphone signal, providing a voice signal from a user, to, e.g., be transmitted via Bluetooth module 107 to the cellular phone. (For the purposes of this disclosure, "phone" includes any type of telephonic communication, including cellular phones and VOIP.) The announcement subsystem 108 may provide announcements, via an announcement signal $u_a(n)$, such as turn-by-turn navigation or the voice of a digital assistant to the amplifier unit 104. The entertainment subsystem 110 may provide music or other entertainment audio, via entertainment audio signal $u_e(n)$, to the amplifier unit 104. The operations of the subsystems described are known and beyond the scope of this disclosure. It should be understood that, apart from the handsfree phone subsystem 106, any other type of subsystem may be provided in addition to or in place of the subsystems described above. Indeed, the announcement subsystem 108 and the entertainment subsystem 110 are merely provided as examples of head unit 102 subsystems that may provide program content signals u(n) to the amplifier unit 104.

The program content signals u(n) may be analog or digital signals and may be provided as compressed and/or packetized streams, and additional information may be received as part of such a stream, such as instructions, commands, or parameters from another system for control and/or configuration of the processing component(s), such as the multichannel echo cancellation unit 112, or other components.

The head unit 102 may be implemented by a processor, or collection of processors, together with a non-transitory storage medium configured to store program code that, when executed by the processor(s), performs the various functions necessary to define the various subsystems of the head unit 102.

Amplifier unit 104 may include an audio presentation processing subsystem 114, a multichannel echo cancellation unit 112, and an amplifier 116. Broadly speaking, the audio presentation processing subsystem 114 may provide various audio processing operations on the received program content signals u(n), such as mixing and loudspeaker routing, to be transduced by one or more acoustic transducer(s) 118. This functionality is, generally, implemented in FIGS. 2A-2D by soundstage rendering 206, although it should be understood that in various examples, audio presentation processing subsystem 114 may include audio processing in addition to soundstage rendering 206 (e.g., upmixing, downmixing, routing, etc.). Indeed, the audio processing of presentation processing subsystem 114, depicted in FIGS. 2A-2D as soundstage rendering 206, is merely provided as an example.

The presentation processing subsystem 114 may be implemented by a processor, or collection of processors, together with a non-transitory storage medium configured to store program code that, when executed by the processor(s), performs the various functions of presentation processing subsystem 114. Generally, the presentation processing subsystem 114 is implemented on a processor(s) distinct from the processor(s) that implement the head unit 102.

Amplifier 116 may amplify the output of the audio presentation processing subsystem 114, driving acoustic transducer 118 to produce an acoustic signal. The amplifier 116 may be implemented by the same processor(s) that defines the audio presentation processing subsystem 114 or by a separate processor(s). In an alternate example, the amplifier 116 may be implemented by hardware or a combination hardware and firmware.

It should be understood that, although the multichannel echo cancellation unit 112 is shown implemented in the amplifier unit 104, in various alternative examples, the multichannel echo cancellation unit 112 may be implemented in a processor or combination of processors distinct from the amplifier 116 or the audio-presentation processing subsystem 114. Indeed, as long as the multichannel echo canceler receives the program content channels u(n) as reference signals, the multichannel echo cancellation unit 112 may be located on a dedicated processor, or elsewhere. As such, the multichannel echo cancellation unit 112, as described herein, is completely modular, and may thus be included in any suitable processor.

The acoustic signal output by acoustic transducer 118 may, undesirably, be picked up by one or more microphone(s) 120. Generally, any aspect of the acoustic production of the acoustic transducer(s) 118 input to microphone(s) 120 is referred to herein as echo.

Multichannel echo cancellation unit 112 generally functions to remove any aspects of echo from the microphone signal, using the program content (e.g., phone signal $u_p(n)$, announcement signal $u_a(n)$, entertainment audio signal $u_e(n)$, etc.) as reference signals, so that a microphone signal including only an estimated user's voice signal $\hat{s}(n)$ (and noise that is uncorrelated with the echo) is provided back to the handsfree phone subsystem 106 of the head unit 102. The multichannel echo cancellation unit 112 thus provides multichannel echo canceling (i.e., several channels of program content u(n)) of the microphone signal y(n). In various examples, the multichannel echo cancellation unit 112 may artificially add an estimate of the echo $d_p(n)$ of the phone signal $u_p(n)$ back to the output estimated voice signal $\hat{s}(n)$ to be canceled by an echo canceler provided in the handsfree phone subsystem 106. As will be described in more detail below, it should be understood that, in various examples, the reference signals received by the multichannel echo cancellation unit 112 are not necessarily the program content signals u(n) output by head unit 102. Rather, some additional audio processing may be applied, e.g., by audio presentation processing 114, to program content signals u(n) before the signals are sent to multichannel echo cancellation unit 112 as reference signals.

The audio presentation processing subsystem 114 and the multichannel echo cancellation unit 112 are shown in greater detail in FIG. 2A-2D. As shown, the multichannel echo cancellation unit 112 may include an echo canceler 200. The echo canceler 200 functions to attempt to remove the echo signal d(n) from the microphone signal y(n) to provide a residual signal e(n). The echo canceler 200 works to minimize the echo signal d(n) by processing the content signals u(n) provided on channels 202 through echo-cancellation filters 204 (multiple echo-cancellation filters together forming a multichannel echo-cancellation filter) to produce an estimated echo signal $\hat{d}(n)$ which is subtracted from the signal y(n) provided by the microphone(s) 120. As mentioned above, in various alternative embodiments, the output of soundstage rendering 206, b(n), rather than program content signals u(n), may be used as the reference signal(s) for echo canceler 200. Indeed, any signal, correlated with at least one the program content signals u(n) and suitable for minimizing the presence the echo signal d(n) in the microphone signal y(n), may be used as a reference signal for echo canceler 200.

The echo canceler 200 may include an adaptive algorithm to update the echo-cancellation filters 204, at intervals, to improve the estimated echo signal $\hat{d}(n)$. Over time, the adaptive algorithm causes the echo-cancellation filters 204 to converge on satisfactory parameters that produce a sufficiently accurate estimated echo signal $\hat{d}(n)$. Generally, the adaptive algorithm updates the echo-cancellation filters 204 during times when the user is not speaking, but in some examples the adaptive algorithm may make updates at any time. When the user speaks, such is deemed "double talk," and the microphone(s) 120 picks up both the acoustic echo signal d(n) and the acoustic voice signal s(n). Double talk may be detected by double talk detector 208, according to any suitable method.

The echo-cancellation filters 204 may apply a set of filter coefficients to the content signal 202 to produce the estimated echo signal $\hat{d}(n)$. The adaptive algorithm may use any of various techniques to determine the filter coefficients and to update, or change, the filter coefficients to improve performance of the echo-cancellation filters 204. Such adaptive algorithms, whether operating on an active filter or a background filter, may include, for example, a least mean squares (LMS) algorithm, a normalized least mean squares (NLMS) algorithm, a recursive least square (RLS) algorithm, or any combination or variation of these or other algorithms. The echo-cancellation filters 204, as adapted by the adaptive algorithm, converge to apply an estimated transfer function $\hat{h}(n)$, which is representative of the echo path between acoustic transducer(s) 118 and microphone(s) 120 to the output of acoustic transducer(s) 118.

Generally speaking, as shown in FIGS. 2A-2D, each adaptive echo-cancellation filter 204 receives, as a reference signal, one of program content signals u(n). For example, echo-cancellation filter 204 is associated with and receives a signal $u_a(n)$ from program content channel 202*a* and may apply a respective transfer function $\hat{h}_a(n)$ representative of the one or more echo path(s) h(n) (that are correlated in some respect to $u_a(n)$ after soundstage rendering 206) and the response of any additional processing, as will be described below. Likewise, the remaining adaptive echo cancellation filters 124 each may be associated with and receive a signal u(n) from program content channel(s) 202, and apply a respective transfer function $\hat{h}(n)$. The respective transfer function of each adaptive echo-cancellation filter 204 is adjusted to minimize an error signal, shown here as echo canceled, residual signal e(n).

It should be understood that the number of adaptive echo-cancellation filters 204 will be dependent, generally, on the number of reference signals received. Thus, if the program content signals u(n) are used as reference signals, some number of echo-cancellation filters 204 equal to the number of program content signals u(n) may be implemented, each echo-cancellation filter 204 being respectively associated with one of program content signals u(n); whereas, if the soundstage rendering output b(n), is used, some N number of echo cancellation filters 204 may be implemented, each echo-cancellation filter 204 being respectively associated with one of N soundstage rendering outputs b(n). It should also be understood that, in some examples, a fewer number of adaptive echo-cancellation filters 204 than, e.g., program content signals u(n) or soundstage rendering outputs b(n), may be used. For example, fewer echo-cancellation filters 204 may be used if certain program content signals u(n), such as a set of woofer left, twiddler left, and twitter left program content signals u(n), are summed together and provided as a reference signal to a single echo-cancellation filter 204, or if only a subset of reference signals need to be used to achieve effective echo cancellation.

In addition to estimating the echo path(s) h(n), estimated transfer function $\hat{h}(n)$ may represent an estimate of any processing disposed between the location from which the reference signals (e.g., program content signals u(n)) are taken and echo canceler 200. Thus, where, as shown in FIG. 1A, the reference signals are program content signals u(n), the estimated transfer function $\hat{h}(n)$ will represent the response of soundstage rendering 206, acoustic transducer(s) 118, microphone(s) 120, and any processing (such as array processing) associated with microphone(s) 120, in addition to the response of the echo path h(n). The estimated transfer function $\hat{h}(n)$ is thus a representation of how the program content signal u(n) is transformed from its received form into the echo signal d(n), in conjunction with the response and any processing performed at microphone 120. If, however, the reference signals are taken at the output of soundstage rendering 206, b(n), the estimated transfer function $\hat{h}(n)$ will collectively represent the response of acoustic transducer(s) 118, echo path h(n), microphone(s) 120, and any processing associated with microphone(s) 120. Thus, although FIGS. 1 and 2 depict three estimated echo signals $\hat{d}(n)$ rather than N estimated echo signals $\hat{d}(n)$, because the response of soundstage rendering 206 is included in estimated transfer function $\hat{h}(n)$, each of estimated echo signals $\hat{d}(n)$ will include the processing of the associated program content signal u(n) by soundstage rendering 206. Accordingly, the sum of the estimated echo signals $\hat{d}(n)$ will estimate the sum of N echo signals d(n).

Figure 2A:
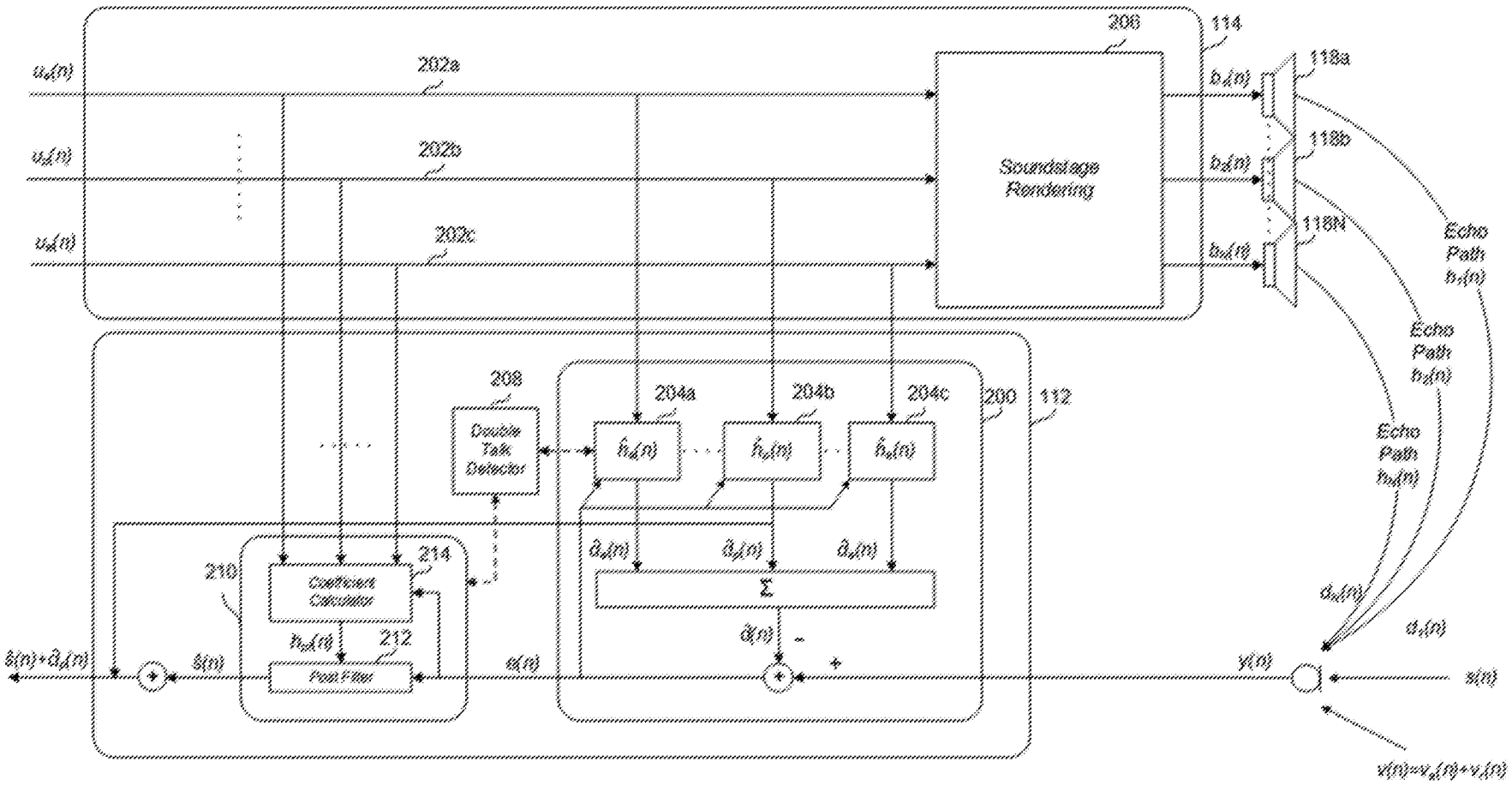
FIG. 2A is a schematic of an audio presentation processing unit and a multichannel echo cancellation unit, according to an example.
Figure 2B:
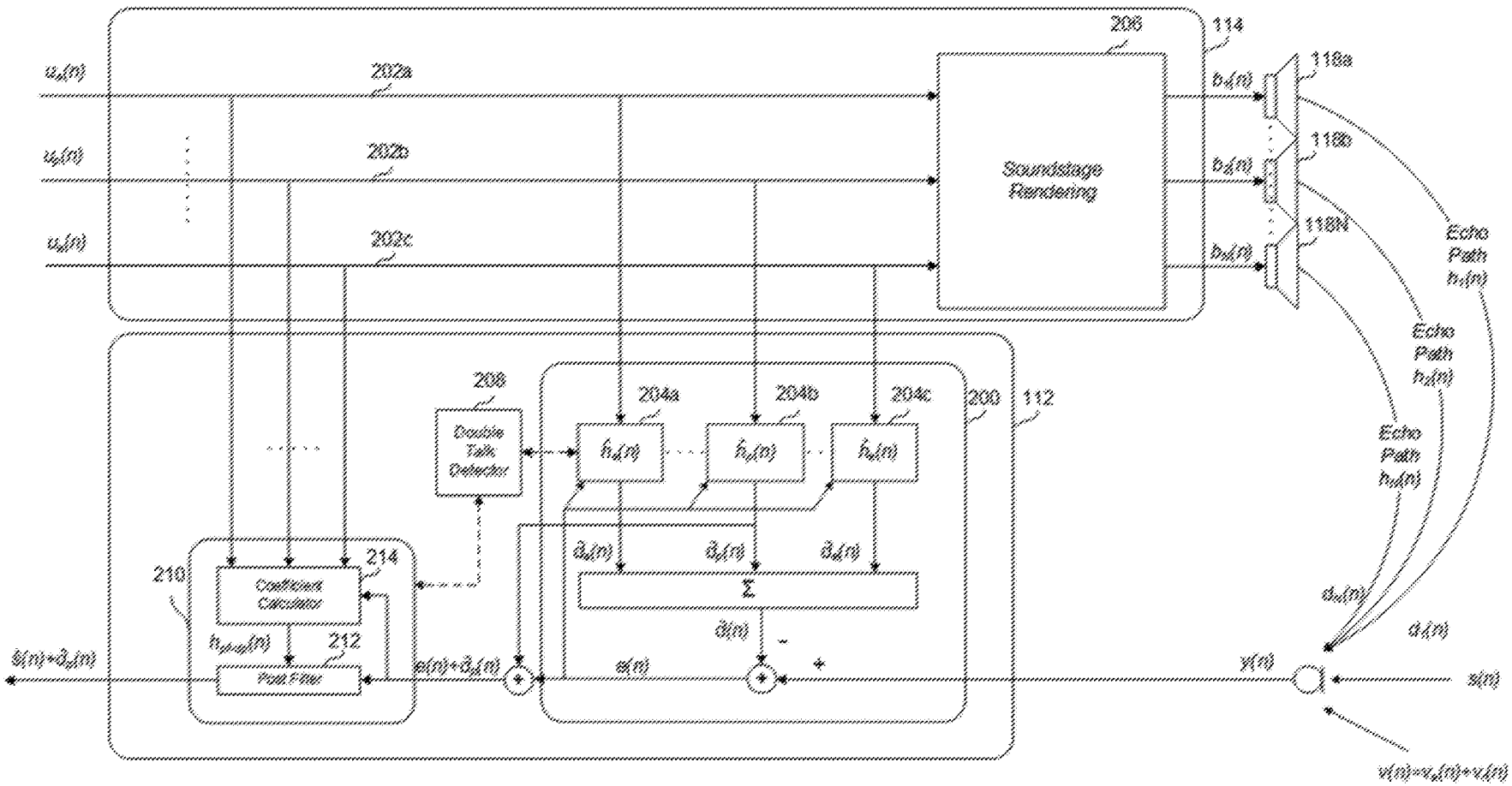
FIG. 2B is a schematic of an audio presentation processing unit and a multichannel echo cancellation unit, according to an example.

In addition, as shown in FIG. 2B, multichannel echo cancellation unit 112 may further include a post filter subsystem 210 configured to suppress residual echo present in the residual signal e(n), by applying spectral filtering in order to produce an improved estimated voice signal $\hat{s}(n)$.

While the echo-canceler 200 cancels linear aspects of the microphone signal y(n) correlated to the program content channels, rapid changes and/or non-linearities in the echo path prevent the echo canceler 200 from providing a precise estimated echo signal d(n), and a residual echo will thus remain in the residual signal e(n). The post filter subsystem 210 thus operates to suppress the residual echo component with spectral filtering to produce an improved estimated voice signal $\hat{s}(n)$. Such post filters are generally known in the art, however a brief description of one example will be provided below.

The post filter subsystem 210 comprises a post filter 212 and a coefficient calculator 214. The post filter 212 suppresses residual echo in the residual signal (from the echo canceler 200) by, in some examples, reducing the spectral content of the residual signal e(n) by an amount related to the likely ratio of the residual echo signal power relative to the total signal power (e.g., speech and residual echo), by frequency bin. In one example, the post filter 212 may multiply each frequency bin (represented by index "k") of the residual signal e(n) by a filter coefficient $H_{pf}(k)$, calculated by coefficient calculator 214, according to the following example equation:

$$H_{pf}(k) = \max\left\{1 - \beta\frac{\sum_{i=1}^{M}[|\Delta H_i(k)|^2 \cdot S_{u_i u_i}(k)]}{S_{ee}(k) + \rho}, H_{min}\right\} \tag{1}$$

where $\Delta H_i(k)$ is a spectral mismatch, $S_{ee}(k)$ is the power spectral density of the residual signal, and $S_{u_i u_i}$ is the power spectral density of the program content signal u(n) on the i-th content channel. Note that the summation is across all program content signals 202. A minimum multiplier, $H_{min}$, is applied to every frequency bin, thereby ensuring that no frequency bin is multiplied by less than the minimum. It should be understood that multiplying by lower values is equivalent to greater attenuation. It should also be noted that in the example of equation (1), each frequency bin is at most multiplied by unity, but other examples may use different approaches to calculate filter coefficients. The β factor is a scaling or overestimation factor that may be used to adjust how aggressively the post filter 212 suppresses signal content, or in some examples may be effectively removed by being equal to unity. The ρ factor is a regularization factor to avoid division by zero.

The spectral mismatch $\Delta H_i(k)$ represents the spectral mismatch between the actual echo path and the acoustic echo canceler 200. The actual echo path is, for example, the entire path taken by the program content signal u(n) from where it is provided to the echo canceler 200, through the soundstage rendering 206, the acoustic transducer(s) 118, the acoustic environment, and through the microphone(s) 120. The actual echo path may further include processing by the microphone(s) 120 or other supporting components, such as array processing, for example. The spectral mismatch $\Delta H_i(k)$ may be calculated as a ratio of the cross-power spectral density of program content signal u(n) on the i-th content channel 202 and the residual signal e(n), $S_{u_i e}$, to the power spectral density of the program content signal u(n) on the i-th content channel 202, $S_{u_i u_i}$ $$\Delta H_i = \frac{S_{u_i e}}{S_{u_i u_i}} \tag{2}$$

In some examples, the power spectral densities used may be time-averaged or otherwise smoothed or low pass filtered to prevent sudden changes (e.g., rapid or significant changes) in the calculated spectral mismatch.

It should be understood that Eqs. 1 and 2 are generally related to the case in which reference signals are uncorrelated. If the reference signals are not necessarily uncorrelated (e.g., a left and right channel pair share some common content), the coefficient calculator 214 may calculate the filter coefficient $H_{pf}(k)$ according to the following equation:

$$H_{pf}(k) = \max\left\{1 - \beta\frac{\Delta H^H(k)\cdot S_{uu}(k)\cdot\Delta H(k)}{S_{ee}(k)+\rho}, H_{min}\right\} \quad (3)$$

where $\Delta H^H$ represents the Hermitian of $\Delta H$, which is the complex conjugate transpose of $\Delta H$, and where $\Delta H$ is given by:

$$\Delta H = S_{uu}^{-1} S_{ue} \quad (4)$$

$S_{uu}$ is the matrix of power spectral densities and cross power spectral densities of the program content channels. $\Delta H$ is the vector containing the spectral mismatch of all channels, and $S_{ue}$ is the vector containing the cross power spectral densities of each reference channel with the error signal.

Although the above equations have been provided for a post filter 212 configured to suppress residual echo from multiple content channels 202, in alternate examples, the post filter 212 may be configured to suppress the residual echo from only one content channel 202.

In various examples, the post filter 212 may be configured to operate in the frequency domain or the time domain. Accordingly, use of the term "filter coefficient" is not intended to limit the post filter 212 to operation in the time domain. The terms "filter coefficients," or other comparable terms, may refer to any set of values applied to or incorporated into a filter to cause a desired response or a desired transfer function. In certain examples, the post filter 212 may be a digital frequency domain filter that operates on a digital version of the estimated voice signal to multiply signal content within a number of individual frequency bins, by distinct values generally less than or equal to unity. The set of distinct values may be deemed filter coefficients.

Both the echo canceler 200 and the post filter subsystem 210 may be configured to calculate the echo-cancellation filter 204 coefficients and the post filter 212 coefficients, respectively, only during periods when a double talk condition is not detected, e.g., by a double talk detector 208. As described above, when a user is speaking within the acoustic environment of the audio system 100, the microphone signal y(n) includes a component that is the user's speech. In this case, the combined signal y(n) is not representative of only the echo from the acoustic transducers 118, and the residual signal e(n) is not representative of the residual echo, e.g., the mismatch of the echo canceler 200 relative to the actual echo path, because the user is speaking. Accordingly, the double talk detector 208 operates to indicate when double talk is detected, new coefficients may not be calculated during this period, and the coefficients in effect at the start or just prior to the user talking may be used while the user is talking. The double talk detector 208 may be any suitable system, component, algorithm, or combination thereof.

The amplifier unit 104, described in connection with FIG. 1, thus provides multichannel echo cancellation in a processor or processors separate and distinct from the processor(s) of the head unit 102. Thus, the estimated voice signal $\hat{s}(n)$ input to the head unit 102 may receive multichannel echo cancellation without transmitting reference signals back to the head unit 102, and without requiring any change to the head unit 102 itself.

However, as described above, many handsfree phone subsystems will also perform some degree of echo cancellation with respect to echo signals correlated to the phone signal $u_p(n)$. Thus, if an echo signal is not found to be present, some handsfree phone subsystems may register an error, interpreting the lack of echo to be indicative of a larger malfunction, such as a malfunctioning microphone. Accordingly, it is advantageous to spoof the phone echo signal $d_p(n)$ and provide it to the handsfree phone subsystem 106.

This may be accomplished in one of several ways, for example, in a first method, the estimated phone echo signal $\hat{d}_p(n)$, as calculated, e.g., by the echo cancellation filter 204*b* (that is, the echo cancellation filter 204 receiving the phone signal $u_p(n)$ as a reference signal), may be included in the coefficient calculation and summed as part of the estimated echo signal $\hat{d}(n)$ and subtracted from the microphone signal y(n) (as described below), but then added to the output signal at, at least, one of two locations, as shown in FIGS. 2A and 2B.

As shown in FIG. 2A the estimated phone echo signal $\hat{d}_p(n)$ may be added at location after the post filter 212 to result in providing the estimated speech $\hat{s}(n)$ and estimated phone echo signal $\hat{d}_p(n)$ at the output of multichannel echo cancellation unit 112. As the post filter 212 would suppress the presence of the phone echo signal $\hat{d}_p(n)$ in the residual signal e(n), adding the signal at a location downstream of the post filter 212 prevents suppressing the estimated phone echo signal $\hat{d}_p(n)$.

Alternatively, as shown in FIG. 2B the estimated phone echo signal $\hat{d}_p(n)$ may be added at a location prior to the post filter 212. In this example, the post filter subsystem 210 may be configured to pass the estimated phone echo signal $\hat{d}_p(n)$ without suppression. For example, the post filter coefficient calculation may be modified to calculate the coefficients, excluding the phone program content signal $u_p(n)$ in the spectral mismatch summation, according to equation (5):

$$H_{pf-d_p}(k) = \max\left\{1 - \beta\frac{\sum_{i\in\mathbb{U}-\{p\}}[|\Delta H_i(k)|^2\cdot S_{u_iu_i}(k)]}{S_{ee}(k)+\rho}, H_{min}\right\} \quad (5)$$

(Here, $i\in\mathbb{U}-\{p\}$ represents excluding the content channel 202*b* from the sum, which includes the phone program content signal $u_p(n)$.) The post filter 212 thus filters the residual signal e(n), without filtering the component of the residual signal correlated to the phone program content signal $u_p(n)$. Stated differently, the post filter 212 will pass the estimated phone echo signal $\hat{d}_p(n)$ through, unfiltered, while spectral mismatches in the remaining components of the residual signal are filtered as normal, again resulting in the estimated speech $\hat{s}(n)$ and estimated phone echo signal $\hat{d}(n)$ at the output of multichannel echo cancellation unit 112.

It should be understood that Eqs. 5 is generally related to the case in which reference signals are uncorrelated. If the reference signals are not necessarily uncorrelated (e.g., a left and right channel pair share some common content), the coefficient calculator 126 may calculate the filter coefficient $H_{pf}(k)$ according to the following equation:

$$H_{pf-d_p}(k) = \max\left\{1 - \beta\frac{\widetilde{\Delta H}^H(k)\cdot\tilde{S}_{uu}(k)\cdot\widetilde{\Delta H}(k)}{S_{ee}(k)+\rho}, H_{min}\right\} \quad (6)$$

In Equation (6) the variables denoted with a tilde exclude the terms corresponding to the phone signal. $\widetilde{\Delta H}$ is $\Delta H$ where the phone channel spectral mismatch $\Delta H_{phone}$ was excluded.

Similarly, $\tilde{s}_{uu}$ is $s_{uu}$ with the phone channel PSD and cross PSDs removed, i.e. one row and one column less.

Figure 2C:
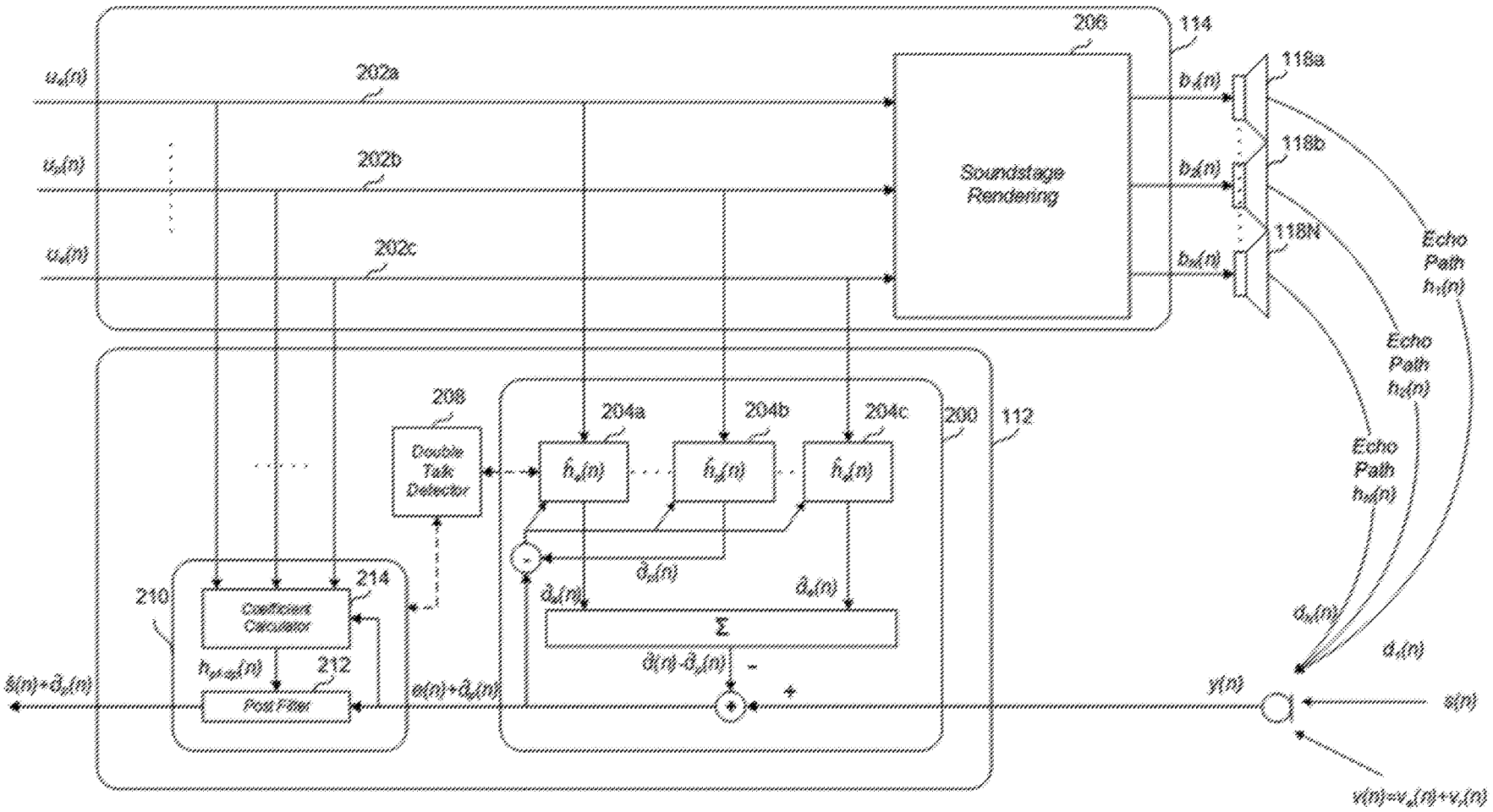
FIG. 2C is a schematic of an audio presentation processing unit and a multichannel echo cancellation unit, according to an example.

In another example, as shown in FIG. 2C, the echo-canceler 200 may calculate the adaptive filter coefficients for each adaptive echo-cancellation filter 204, including the reference signal from the phone signal $u_p(n)$ in the coefficient calculation, but exclude (or otherwise not generate) an estimated phone echo signal $d_p(n)$ from the sum of the echo-cancellation filters 204 (thus, the output of 204*b*, as shown in FIG. 2C, is not included in the summation). The summed output of the echo cancellation filters 204 may thus be represented as $\hat{d}(n)-\hat{d}_p(n)$. This will result in estimated echo $\hat{d}_p(n)$ correlated to the phone program content signal $u_p(n)$ remaining in the residual signal, e(n). This is represented in FIG. 2C as $e(n)+\hat{d}_p(n)$. To prevent the estimated echo $\hat{d}_p(n)$ correlated to the phone program content signal $u_p(n)$ from skewing the adaptation of the echo-cancellation filters 204, the estimated echo $\hat{d}_p(n)$ may be subtracted from the error signal of the echo-cancellation filters 204.

Figure 2D:
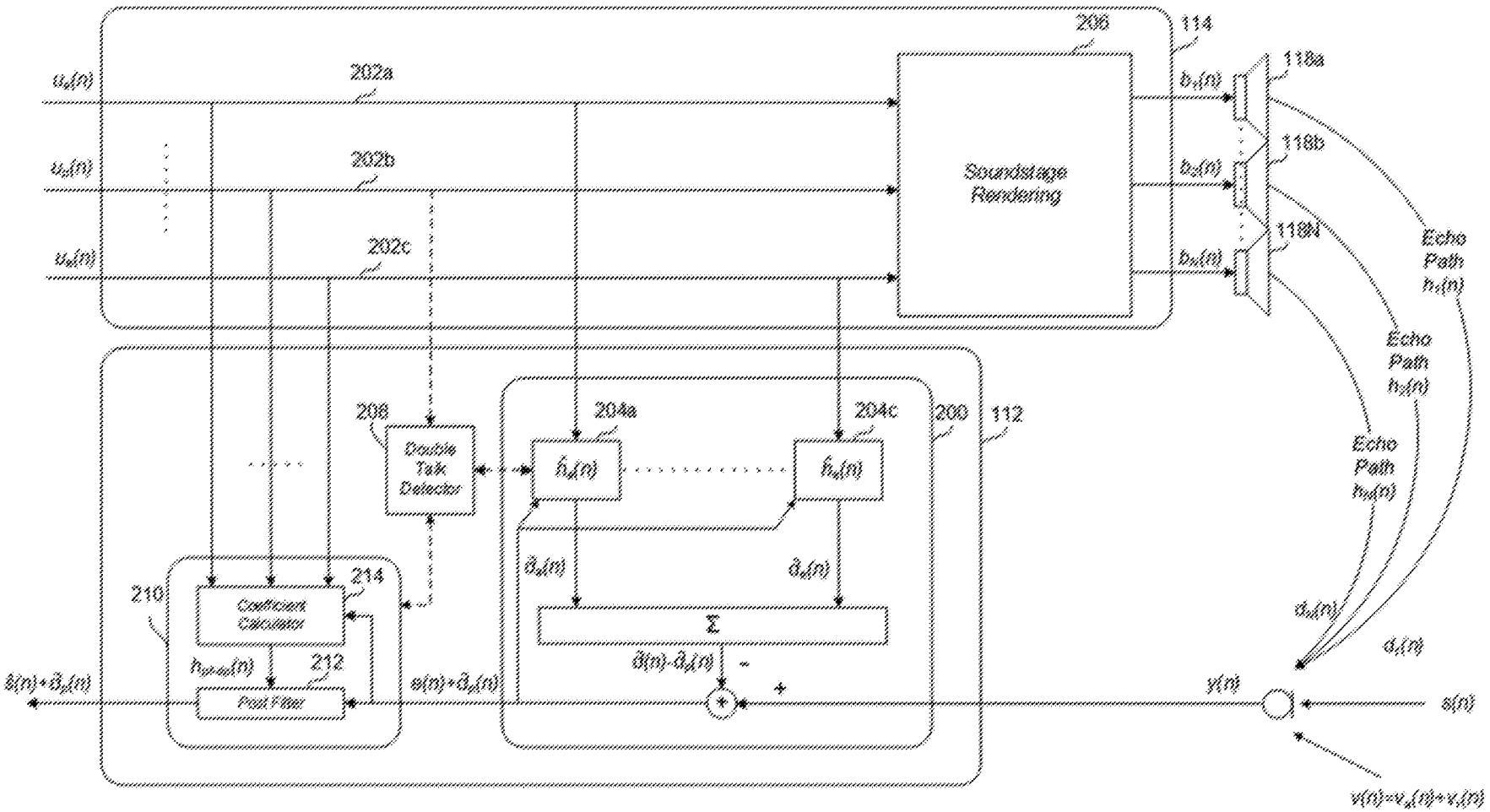
FIG. 2D is a schematic of an audio presentation processing unit and a multichannel echo cancellation unit, according to an example.

In another example, shown in FIG. 2D, the echo-canceler 200 may exclude echo cancellation filter 204*b*, which receives the phone program content signal $u_p(n)$. Like the example of FIG. 2C, the summed output of the echo cancellation filters 204 may be represented as $\hat{d}(n)-\hat{d}_p(n)$. This will similarly result in estimated echo $\hat{d}_p(n)$ correlated to the phone program content signal $u_p(n)$ remaining in the residual signal, represented as $e(n)+\hat{d}_p(n)$. However, to prevent the estimated echo $\hat{d}_p(n)$ from skewing adaptation of the echo-cancellation filters 204, double-talk detector 208 may be used to pause adaption of echo cancellation filters 204, when a signal is present on the phone program content channel 202*b*. In other words, the echo cancellation filters 204 are not updated while there is some phone program content signal $u_p(n)$.

The example described in connection with FIGS. 2C and 2D require the post filter 212 to again pass the estimated phone echo signal $\hat{d}_p(n)$ as described in connection with FIG. 2B. The examples described in connection with FIGS. 2C and 2D, will result in providing the estimated speech $\hat{s}(n)$ and estimated phone echo signal $\hat{d}_p(n)$ at the output of multichannel echo cancellation unit 112.

The above examples of 2A-2D thus depict methods of providing the estimated phone echo signal $\hat{d}_p(n)$ at the output of the multichannel echo cancellation unit 112, where it may be canceled by the handsfree phone subsystem of the handsfree phone subsystem 106.

It should be understood that, in this disclosure, a capital letter used as an identifier or as a subscript represents any number of the structure or signal with which the subscript or identifier is used. Thus, acoustic transducer 118N represents the notion that any number of acoustic transducers 118 may be implemented in various examples. Indeed, in some examples, only one acoustic transducer may be implemented. Likewise, soundstage rendering output signal $b_N(n)$ represents the notion that any number of soundstage rendering output signals b(n) may be used. It should be understood that, the same letter used for different signals or structures, e.g., soundstage rendering output $b_N(n)$ and echo signals $\hat{d}_N(n)$, represents the general case in which there exists the same number of a particular signal or structure. Thus, in the general case, there will be the same number of soundstage rendering outputs $b_N(n)$ and echo signals $\hat{d}_N(n)$. The general case, however, should not be deemed limiting. A person of ordinary skill in the art will understand, in conjunction with a review of this disclosure, that, in certain examples, a different number of such signals or structures may be used.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media or storage device, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random-access memory or both. Components of a computer include a processor for executing instructions and one or more memory devices for storing instructions and data.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the inventive scope of the present disclosure.

What is claimed is:

1. An audio system, comprising:

a head unit comprising at least a first processor, the head unit being configured to generate a plurality of program content signals, one of the plurality of program content signals being a phone program content signal being received from a phone, wherein the plurality of program content signals are transduced by an acoustic transducer into an acoustic signal within a cabin of a vehicle, wherein the head unit is disposed in a first location within the vehicle;

a microphone disposed within the vehicle cabin such that the microphone receives the acoustic signal and produces a microphone signal comprising a plurality of echo signals, each echo signal of the plurality of echo signals being a component of the microphone signal correlated to at least one program content signal of the plurality of program content signals;

a multichannel echo-cancellation unit being implemented by a second processor, the multichannel echo-cancellation unit being configured to receive a plurality of reference signals, each of the plurality of reference signals being correlated to at least one of the plurality of program content signals, and the microphone signal, and to minimize the plurality of echo signals, according to the plurality of reference signals, to produce an estimated voice signal, and to provide the estimated voice signal to the head unit, wherein the multichannel echo-cancellation unit is disposed in a second location within the vehicle, wherein the first location is different from the second location such that the multichannel echo-cancellation unit is positioned outside of the head unit.

2. The audio system of claim 1, wherein the multichannel echo-cancellation unit comprises a multichannel echo-cancellation filter configured to provide an estimate of the plurality of echo signals, the estimate of the plurality of echo signals being subtracted from the microphone signal to produce the estimated voice signal, wherein an estimated phone program content echo signal, being correlated to the phone program content signal, is added to the estimated voice signal, such that the estimated voice signal and the estimated phone program content echo signal is provided to the head unit.

3. The audio system of claim 2, further comprising a post filter configured to receive the estimated voice signal and to suppress at least one residual component correlated to at least one of the plurality of program content signals to produce an echo-suppressed estimated voice signal.

4. The audio system of claim 3, wherein the estimated phone program content echo signal is added to the echo-suppressed estimated voice signal.

5. The audio system of claim 3, wherein the post filter is configured to receive the estimated voice signal and the estimated phone program content echo signal and to output the echo-suppressed estimated voice signal and the estimated phone program content echo signal, wherein the estimated phone program content echo signal remains unsuppressed.

6. The audio system of claim 5, wherein the post filter is configured to output the estimated phone program content echo signal unsuppressed by excluding the estimated phone program content echo signal from a spectral mismatch summation.

7. The audio system of claim 1, wherein the plurality of reference signals comprises the plurality of program content signals.

8. A multichannel echo cancellation unit being implemented on a first processor, comprising:

at least one program content input to receive a plurality of reference signals, each of the plurality of reference signals being correlated to at least one of a plurality of program content signals output from a head unit including a second processor, one of the plurality of program content signals being a phone program content signal, wherein the head unit is disposed in a first location within a vehicle, wherein the first processor disposed in a second location within the vehicle, wherein the first location is different from the second location such that the first processor is positioned outside of the head unit;

a microphone input to receive a microphone signal comprising a plurality of echo signals, each echo signal of the plurality of echo signals being a component of the microphone signal correlated to at least one program content signal of the plurality of program content signals;

an echo canceler being configured to minimize the plurality of echo signals, according to the plurality of reference signals, to produce an estimated voice signal and to provide the estimated voice signal to the head unit.

9. The multichannel echo cancellation unit of claim 8, wherein the echo canceler comprises a multichannel echo-cancellation filter configured to provide an estimate of the plurality of echo signals, the estimate of the plurality of echo signals being subtracted from the microphone signal to produce the estimated voice signal, wherein an estimated phone program content echo signal, being correlated to the phone program content signal, is added to the estimated voice signal, such that the estimated voice signal and the estimated phone program content echo signal is provided to the head unit.

10. The multichannel echo cancellation unit of claim 9, further comprising a post filter configured to receive the estimated voice signal and to suppress at least one residual component correlated to the plurality of program content signals to produce an echo-suppressed estimated voice signal.

11. The multichannel echo cancellation unit of claim 10, wherein the estimated phone program content echo signal is added to the echo-suppressed estimated voice signal.

12. The multichannel echo cancellation unit of claim 10, wherein the post filter is configured to receive the estimated voice signal and the estimated phone program content echo signal and to output the echo-suppressed estimated voice signal and the estimated phone program content echo signal, wherein the estimated phone program content echo signal remains unsuppressed.

13. The multichannel echo cancellation unit of claim 12, wherein the post filter is configured to output the estimated phone program content echo signal unsuppressed by excluding the estimated phone program content echo signal from a spectral mismatch summation.

14. A method for performing multichannel echo cancellation, comprising:

receiving, at a first processor, a plurality of reference signals, each of the plurality reference signals being correlated to at least one of a plurality of program content signals output from a head unit including a second processor, one of the plurality of program content signals being a phone program content signal, wherein the head unit is disposed in a first location within a vehicle, wherein the first processor disposed in a second location within the vehicle, wherein the first location is different from the second location such that the first processor is positioned outside of the head unit;

receiving a microphone signal comprising a plurality of echo signals, each echo signal of the plurality of echo signals being a component of the microphone signal correlated to at least one program content signal of the plurality of program content signals;

minimizing, with an echo canceler defined by first processor, the plurality of echo signals, according to a plurality of reference signals, to produce an estimated voice signal; and providing the estimated voice signal to the head unit.

15. The method of claim 14, wherein the step of minimizing the plurality of echo signals comprises:

generating, with a multichannel echo-cancellation filter being defined by the first processor, an estimate of the plurality of echo signals, the estimate of the plurality of echo signals being subtracted from the microphone signal to produce the estimated voice signal.

16. The method of claim 15, further comprising:

adding an estimated phone program content echo signal, being correlated to the phone program content signal, to the estimated voice signal, such that the estimated voice signal and the estimated phone program content echo signal is provided to the head unit.

17. The method of claim 16, further comprising:

receiving the estimated voice signal at a post filter, the post filter being implemented by the first processor; and applying a suppression, with the post filter, to at least one residual component correlated to the plurality of program content signals to produce an echo-suppressed estimated voice signal.

18. The method of claim 17, wherein the estimated phone program content echo signal is added to the echo-suppressed estimated voice signal.

19. The method of claim 17, further comprising:

receiving the estimated phone program content echo signal at the post filter;

outputting, from the post filter, the estimated phone program content echo signal unsuppressed.

20. The method of claim 19, wherein the post filter is configured to output the estimated phone program content echo signal unsuppressed by excluding the estimated phone program content echo signal from a spectral mismatch summation.

* * * * *